United States Patent [19]

Tröger et al.

[11] Patent Number: 4,561,992

[45] Date of Patent: Dec. 31, 1985

[54] AEROSOL CLEANING AGENT FOR TEXTILE SURFACES

[75] Inventors: Wolfgang Tröger, Pulheim; Otto Mesmer; Renate Friedrichs, both of Wuppertal, all of Fed. Rep. of Germany

[73] Assignee: Vorwerk & Co. Interholding GmbH, Wuppertal, Fed. Rep. of Germany

[21] Appl. No.: 461,366

[22] Filed: Jan. 27, 1983

[30] Foreign Application Priority Data

Feb. 20, 1982 [DE] Fed. Rep. of Germany ..... 3206146

[51] Int. Cl.[4] ..... C11D 3/12; C11D 3/26

[52] U.S. Cl. ..... 252/155; 252/88; 252/89.1; 252/90; 252/140; 252/153; 252/173; 252/174.13; 252/174.15; 252/174.23; 252/174.25; 252/DIG. 2

[58] Field of Search ..... 252/89.1, 88, 90–92, 252/140, 153, 155, 163, 165, 174.15, 174.23, 174.25, 541, 544, DIG. 2, 173

[56] References Cited

U.S. PATENT DOCUMENTS

| | | | |
|---|---|---|---|
| 3,206,408 | 9/1965 | Vitalis et al. | 252/140 X |
| 3,714,049 | 1/1973 | Charle et al. | 252/90 |
| 3,716,488 | 2/1973 | Kolsky et al. | 252/155 |
| 3,910,848 | 10/1975 | Froehlich et al. | 252/90 |
| 3,956,162 | 5/1976 | Lautenberger | 252/162 |
| 4,244,834 | 1/1981 | Schwalley et al. | 252/106 |
| 4,326,053 | 4/1982 | Kang et al. | 536/1 |
| 4,390,541 | 6/1983 | Havinga et al. | 252/311 |
| 4,493,781 | 1/1985 | Chapman et al. | 252/88 |

FOREIGN PATENT DOCUMENTS

| | | |
|---|---|---|
| 737654 | 2/1970 | Belgium . |
| 2240287 | 4/1975 | France . |

*Primary Examiner*—Prince E. Willis

*Attorney, Agent, or Firm*—Martin A. Farber

[57] ABSTRACT

An aerosol cleaning agent for textile surfaces, particularly for the cleaning of textile upholstery, contains a plasticized urea-formaldehyde resin foam, a propellant, an antisettling and suspending agent respectively and a liquid. In order to obtain improved cleaning action and improved removability from the article to be cleaned, the aerosol cleaning agent comprises approximately 65 to 75 wt % active substance. This active substance contains sodium-aluminum silicate suspended therein and buffered by acid to a pH of about 7–8—and the plasticized urea-formaldehyde resin foam has open-cell foam particles and is present in particle sizes between the limit values of about 0.005 and 0.120 mm and a density (in dry, non-comminuted condition) of about 50 plus or minus 10 kg/m$^3$. Therefore it is possible to dispense with the addition of a moisture-retaining cation-active antistatic.

16 Claims, 1 Drawing Figure

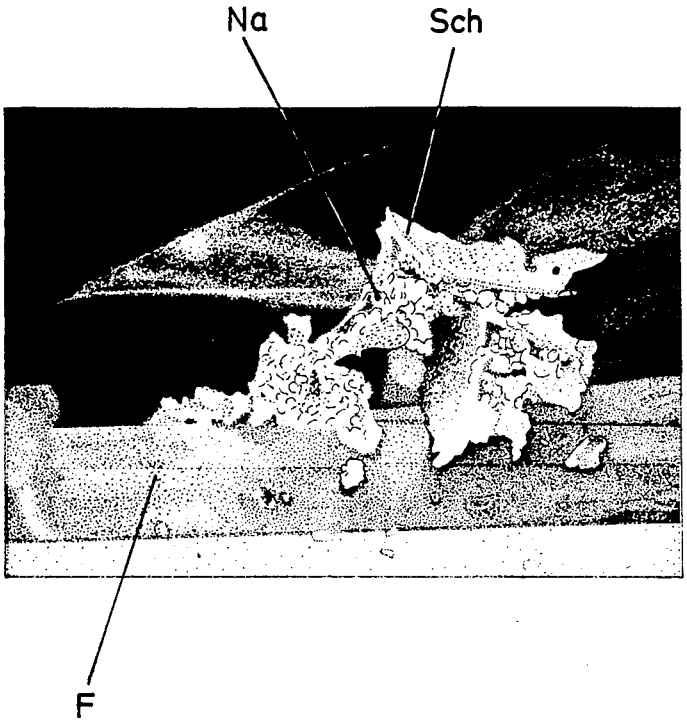
Na
Sch
F

AEROSOL CLEANING AGENT FOR TEXTILE SURFACES

The present invention relates to an aerosol cleaning agent for textile surfaces, for the cleaning of textile cushions, containing an urea-formaldehyde polymer, a propellant, an antisettling and suspension agent, respectively, and a liquid.

In the known cleaning agents of this type (West German Patent No. 25 11 854) the liquid comprises a halogen-containing solvent and the urea-formaldehyde polymer comprises a powder, a cation-active antistatic being added in order to obtain improved removability of the dirt-containing substances from carpets or upholstery articles, particularly with a vacuum cleaner.

The cleaning action of these known agents is not optimal. In addition, there is the negative effect of the cation-active antistatic, namely it holds the moisture on the carpet or upholstery material, which causes further dirtying of the cleaned article.

The object of the invention is to provide a cleaning agent of this type with improved cleaning action and improved ability to be removed from the article to be cleaned, particularly by vacuuming, and to do this preferably without requiring the addition of a cation-active antistatic.

This object is achieved by an aerosol cleaning agent comprising approximately 65 to 75 wt% active substance. This active substance contains suspended sodium aluminum silicate which is buffered by acid to a pH range of about 7–8, and a plasticized urea-formaldehyde resin foam having open-cell foam particles in particle sizes between limit values of about 0.005 and 0.120 mm and with a density (in dry non-comminuted condition) of about 50 plus or minus 10 kg/m$^3$.

The essential cleaning action resides in the sodium-aluminum silicate. The high cleaning power of sodium aluminum silicates is well-known in the field of detergents. There, however, in view of the large quantities of rinse water present, the problem of dry removal, particularly by vacuuming, of the cleaning substances carrying the particles of dirt does not arise. The fact that an aqueous suspension is involved instead of the use of considerable quantities of halogen-like solvents results in a gentler and better cleaning effect. The use of the urea-formaldehyde resin foam in the form of open-cell foam particles of corresponding density in uncomminuted form and within a suitable range of particle size results, as has surprisingly been found, in practically 100% removal of the cleaning agent carrying the particles of dirt by merely brushing or vacuuming, for instance by means of a vacuum brush. The open-cell foam particles have been found to perform a carrier/transport function for the sodium aluminum silicate particles.

The latter settle on the particles of foam material and are carried along or entrained during the movement of the particles of foam material, the physical structure and the mechanical surface structure specifically of open-cell foam particles playing a considerable part in this "piggy-back" effect. In addition to this, as has also been ascertained in extensive experiments, there is the effect that the suitably shaped surface of the open-cell foam particles during their movement also exerts a favorable abrasive action on the fibers of the carpet or upholstery material. The following percentages by weight were found to be optimum: The active substance comprises approximately 1–30 wt% of suspended sodium aluminum silicate and about 2–15 wt% of urea-formaldehyde resin foam with respect to dry weight. If a low-molecular alcohol is further added as a solvent, it provides the ability of also cleaning grease stains; the proposed addition of a wash-active substance, as is also advantageous, increases the cleaning action; and the addition of a silicone defoamer promotes the removal of any residue of soap from earlier cleaning processes with other cleaning agents.

With the above and other objects and advantages in view, the present invention will become more clearly understood in connection with the detailed description of a preferred embodiment, when considered with the accompanying drawing, in which the only FIGURE is an electron-microscope photograph of the aerosol cleaning agent of the invention acting on dirt particles on a carpet.

The composition of the cleaning agent of the invention in the embodiment which has been found optimum is as follows:

| | |
|---|---|
| 1. NaAl silicate (trade name HAB A 100) | 10.00 wt % |
| 2. Urea-formaldehyde resin foam | 5.00 wt % |
| 3. Polysaccharide (Kelzan) as the antisettling and suspension agent, respectively | 0.05 wt % |
| All the above percentages by weight refer to the dry weight | |
| 4. Cosmetically pure isopropanol | 10.00 wt % |
| 5. Wash-active substance (Ubatol VTR 317) | 2.50 wt % |
| 6. Acetic acid, at least 96 wt % purest corresponding to DAB 6 | 0.40 wt % |
| 7. Silicone defoamer (Baysilon) | 0.20 wt % |
| 8. Perfume (Kobanja HL 1368 0/218710) | 0.10 wt % |
| 9. Water of 10° German hardness | 71.75 wt % |
| Total | 100.00 wt % |

In the optimum embodiment described above, the active substance 1–9 above is introduced into the aerosol in an amount of 65.0 wt%, where 35.0 wt% propellant gas is also introduced into the aerosal. As the propellant a propane-butane mixture of reduced inflammability is used.

The residual moisture of the carrier materials should be at most 20.00 wt%. The moisture found is to be deducted from the water content of the formula when making the product.

The density of the urea-formaldehyde foam material prior to the comminution (dry), is within the range of 50 plus or minus 10 kg per cubic meter, measured in block form. The bulk weight of the foam material is within the range of 150 plus or minus 50 g per liter. In the latter preferred embodiment, about 1–30 wt% of sodium aluminum silicate and about 2–15 wt% of urea-formaldehyde resin foam (in dry weights) are preferred. Furthermore, in any of the above-mentioned embodiments a low-molecular alcohol can be added as a solvent in an amount of about 2–10 wt%, along with a wash-active substance in an amount of about 0.5–5.0 wt% and a silicone defoamer in an amount of about 0.1–1.0 wt%. The bulk weight of the sodium aluminum silicate should lie within the range of 450 plus or minus 100 grams per liter.

The particle size distribution of the urea-formaldehyde foam is optimally as follows:

less than 0.110 mm: 100 wt% less than 0.080 mm, min.: 90 wt%

The optimum particle size distribution of the sodium aluminum silicate is approximately as follows:

less than 0.080 mm: 100 wt% average particle size: 0.012–0.010 mm.

The solid content of the product is 14.5 plus or minus 0.5 wt%. The pH of the active substance solution must be 7.5 plus or minus 0.5. The density of the active substance at 20° Celsius should be about 1.060 plus or minus 0.005 g/cm$^3$.

The accompanying illustration is an electron-microscope photograph in a 1000× magnification. It demonstrates the surprising manner of action of the open-cell foam particles in relation to the sodium-aluminum silicate particles, which sodium-aluminum silicate particles in themselves are optimum for cleaning purposes. F is the carpet-upholstery fiber. Sch are the open-cell foam particles and Na are the sodium-aluminum silicate particles. There can be noted the resultant "piggy-back" effect of the sodium-aluminum silicate particles to the foam particles, which sodium-aluminum silicate particles have taken up (absorbed) most of or the essential part of the particles of dirt, and it can also be seen that the movement of the particle of foam out of the position shown will exert a certain abrasive action along the fiber, including an entrainment action on further sodium-aluminum silicate particles. In particular, this action of the urea-formaldehyde resin foam used in the form of a plasticized foam makes it unnecessary, for instance, to employ antistatics, with their negative accompanying phenomena.

We claim:

1. An aerosol cleaning agent for textile surfaces, particularly for the cleaning of textile upholstery, comprising a propellant, and approximately 65 to 75 wt% of an active substance comprising:

suspended sodium aluminum silicate particles which are buffered by acid to a pH range of about 7–8;

a plasticized urea-formaldehyde resin foam having open-cell foam particles in particle sizes between limit values of about 0.005 and 0.120 mm and with a density (in dry non-comminuted condition) of about 50 plus or minus 10 kg/m$^3$, said open-cell urea-formaldehyde resin foam particles perform a carrier transport function for said sodium aluminum silicate particles producing a piggy-back effect.

2. The aerosol cleaning agent according to claim 1, wherein said active substance comprises about 1–30 wt% of said suspended sodium aluminum silicate particles and about 2–15 wt% of the urea-formaldehyde resin foam with respect to dry weight.

3. The aerosol cleaning agent according to claim 1, wherein said propellant comprises 35 wt% of said aerosol cleaning agent, and wherein said active substance comprises 65 wt% of said aerosol cleaning agent.

4. The aerosol cleaning agent according to claim 3, wherein the density of the NaAl silicate particles at 20° Celsius is approximately 1.055 to 1.065 g/cm$^3$.

5. The aerosol cleaning agent according to claim 1, wherein said active substance further comprises a low-molecular alcohol as a solvent in an amount of about 2–10 wt%, a silicone defoamer in an amount of about 0.01 to 1.0 wt%.

6. The aerosol cleaning agent according to claim 1, wherein the particle size distribution of the urea-formaldehyde foam is approximately:

less than 0.110 mm: 100 wt% less than 0.080 mm: 90 wt%.

7. The aerosol cleaning agent according to claim 1, wherein the particle size distribution of the sodium aluminum silicate particles is approximately as follows:

less than 0.080 mm: 100 wt% average particle size 0.012–0.010 mm.

8. An aerosol cleaning agent for textile surfaces, particularly for the cleaning of textile upholstery, consisting essentially of 1 to 30% by weight (relative to the active substance solids content) of suspended NaAl silicate particles, about 2 to 15% by weight (relative to the active-substance solids content) of particles of urea-formaldehyde resin foam which open-cell foam having a bulk weight (in dry, uncomminuted condition) of about 40 to 60 kg/m$^3$, isopropanol, acetic acid, silicone defoamer, and water, said open-cell urea-formaldehyde resin foam particles performing a carrier transport function for said sodium aluminum silicate particles producing a piggy-back effect.

9. The aerosol cleaning agent according to claim 8, wherein the solids content is from 14 to 15 wt%.

10. In an aerosol cleaning agent for textile surfaces, the agent comprising a propellant and an active substance comprising about 2 to 15% by weight (relative to the active-substance solids content) of particles of urea-formaldehyde-resin foam having a particle size of less than 0.120 mm, the improvement wherein the urea-formaldehyde-resin foam particles comprise open-cell foam having a bulk weight (in dry, uncomminuted condition) of about 50±10 kg/m$^3$, and said active substance further comprising 1 to 30% by weight (relative to the active substance solids content) of a suspended sodium aluminum silicate, buffered by acid to a pH range of about 7–8, the suspended sodium aluminum silicate particles being present in an average particle size of 0.012–0.010 mm, said open-cell urea-formaldehyde resin foam particles performing a carrier transport function for said sodium aluminum silicate particles producing a piggy-back effect.

11. A process for cleaning a textile surface comprising applying to said surface an aerosol cleaning agent for textile surfaces comprising from 25 to 35 wt% of a propellant and from 65 to 75 wt % of an active substance, said active substance comprising suspended particles of sodium aluminum silicate which is buffered by acid to a pH range of about 7–8, and a plasticized urea-formaldehyde resin foam having open-cell foam particles in particle sizes between limit values of about 0.005 and 0.120 mm and with a density (in dry non-comminuted condition) of about 50 plus or minus 10 kg/m$^3$, and removing said cleaning agent from said textile surface, wherein said open-cell urea-formaldehyde resin foam particles perform a carrier transport function for the sodium aluminum silicate producing a piggy-back effect, and whereby there is the effect that the suitably shaped surface of the open-cell foam particles during their movement also exerts a favorable abrasive action on the fibers of the textile surface.

12. The process according to claim 11, wherein said active substance comprises about 1–30 wt% of said suspended sodium aluminum silicate and about 2–15 wt% of the urea-formaldehyde resin foam with respect to dry weight.

13. The process according to claim 11, wherein said active substance further comprises a low-molecular alcohol as a solvent in an amount of about 2–10 wt%, a silicone defoamer in an amount of about 0.01 to 1.0 wt%.

14. The process according to claim 11, wherein the particle size distribution of the urea-formaldehyde foam is approximately:

less than 0.110 mm: 100 wt% less than 0.080 mm: 90 wt%.

15. The process according to claim 11, wherein the particle size distribution of the sodium aluminum silicate particles is approximately as follows:

less than 0.080 mm: 100 wt% average particle size 0.012–0.010 mm.

16. The process according to claim 11, wherein said removing step comprises vacuuming.

* * * * *